United States Patent [19]

Oyama et al.

[11] 4,201,465

[45] May 6, 1980

[54] DRUM CLEANING PROCESS AND APPARATUS FOR ELECTROPHOTOGRAPHY

[75] Inventors: Hazime Oyama; Kohji Suzuki; Manabu Mochizuki; Teruyuki Ohnuma, all of Tokyo, Japan

[73] Assignee: Ricoh Company, Ltd., Tokyo, Japan

[21] Appl. No.: 919,640

[22] Filed: Jun. 27, 1978

Related U.S. Application Data

[63] Continuation of Ser. No. 723,275, Sep. 15, 1976, abandoned.

[30] Foreign Application Priority Data

Nov. 26, 1975 [JP] Japan ..... 50/141410

[51] Int. Cl.[2] ..... G03G 21/00

[52] U.S. Cl. ..... 355/15; 15/1.5 R; 118/652; 250/325; 355/3 CH; 430/125

[58] Field of Search ..... 355/15, 3 DD, 3 R, 3 CH; 118/652; 15/1.5 R, 256.51, 256.52; 427/14; 96/1 R; 250/324–326

[56] References Cited

U.S. PATENT DOCUMENTS

| | | | |
|---|---|---|---|
| 3,637,306 | 1/1972 | Cooper | 355/15 |
| 3,647,293 | 3/1972 | Queener | 355/15 |
| 3,797,927 | 3/1974 | Takahashi et al. | 355/3 R |
| 3,914,045 | 10/1975 | Namiki et al. | 355/15 |

OTHER PUBLICATIONS

*IBM Tech. Disc. Bull.,* "Xerographic System", vol. 16, No. 9, Feb. 1974, p. 2958.

*Primary Examiner*—R. L. Moses
*Attorney, Agent, or Firm*—Frank J. Jordan

[57] ABSTRACT

Charging, imaging, developing, transfer and cleaning units are operatively arranged about the circumference of a rotary photoconductive drum, the developing unit comprising a magnetic brush. A discharge unit is disposed between the transfer unit and the cleaning unit and comprises a light source and a corona discharge element to simultaneously illuminate the drum causing photoconduction and expose the drum to an electric field thereby neutralizing any residual charge on the drum and residual toner particles remaining on the drum after the transfer operation. The residual toner is subsequently removed by the magnetic brush of the developing unit.

21 Claims, 5 Drawing Figures

DRUM CLEANING PROCESS AND APPARATUS FOR ELECTROPHOTOGRAPHY

This is a continuation of application Ser. No. 723,275, filed Sept. 15, 1976 now abandoned.

BACKGROUND OF THE INVENTION

The present invention relates to a drum cleaning process and apparatus for electrostatic photography by which residual toner particles are throughly removed from a photoconductive element after a transfer operation.

In a well known dry type electrophotographic process, a photoconductive drum or belt is electrostatically charged, radiated with a light image to cause local photoconduction and produce an electrostatic image, developed by applying a toner substance thereto to form a toner image and subjected to a transfer operation in which the toner image is transferred to a copy sheet. In practical application, it is impossible to transfer the toner image to the copy sheet completely, and residual toner remains on the drum after the transfer operation.

In order to utilize the drum for sucessive copying operations of different original documents, it is necessary to remove this residual toner from the drum, since double printing would occur if it were not removed.

In a wet electrophotographic process, a scraper blade is used to remove the residual toner. However, this expedient is not applicable to a dry electrophotographic process since abrasion of the delicate photoconductive surface layer on the drum would occur due to dry friction.

In order to remove the residual toner, it is necessary to dissipate the electrostatic image on the drum which strongly binds the residual toner to the drum surface. For this reason, most conventional dry electrophotographic machines comprise a corona discharge unit to apply an electric field opposite in polarity to the initial electrostatic charge to neutralize the electrostatic image on the drum, and a light source to subsequently illuminate the drum surface to cause photoconduction and further discharge of the drum. Since the electrostatic force between the residual toner and drum is reduced substantially, the residual toner may be more readily removed from the drum by a magnetic brush or the like.

A drawback exists in this prior art expedient in that the corona discharge is performed in the absence of light. The conductivity of the photoconductive layer in the dark is high, and it is impossible to dissipate the electrostatic charge in the lowermost portion of the layer. Even the subsequent exposure to light does not produce complete discharge, and the problem of double printing is not effectively solved.

SUMMARY OF THE INVENTION

It is an object of the present invention to provide a process for completely removing residual toner from a photoconductive member of an electrophotographic apparatus after a toner image transfer operation.

It is another object of the present invention to provide an electrophotographic apparatus embodying the process.

It is another object of the present invention to provide an electrophotographic process in which an electrostatic attractive force between residual toner particles and a photoconductive drum is dissipated through a simultaneous illumination of the drum surface with light and exposure of the drum surface to an electric field thereby effecting complete discharge of the drum and toner.

It is another object of the present invention to provide an electrophotographic process in which complete discharge of a photoconductive drum is produced by simultaneous illumination of the drum surface by light and exposure of the drum surface to an electric field, the effect of said steps in combination being greater than the aggregate effect of said steps performed sequentially.

It is another object of the present invention to provide an electrophotographic apparatus in which a magnetic brush which is used to apply toner substance to a photoconductive drum for development is also used to remove residual toner from the drum after a discharge operation comprising the simultaneous steps of illuminating the drum surface with light and exposing the drum to an electric field.

It is another object of the present invention to provide an electrophotographic apparatus in which a photoconductive drum is rotated adjacent to a light source and a corona discharge unit which simultaneously operate on the drum to dissipate an electrostatic charge thereon, the area of radiation of light on the drum surface overlapping the area of the electric field on the drum surface and extending downstream of the area of the electric field in the direction of rotation of the drum.

It is another object of the present invention to provide a generally improved electrophotographic process and apparatus embodying the process.

Other objects, together with the foregoing, are attained in the embodiments of the present invention described in the following description and shown in the accompanying drawings.

DESCRIPTION OF THE PREFERRED EMBODIMENTS

While the electrophotographic apparatus of the invention is susceptible of numerous physical embodiments, depending upon the environment and requirements of use, substantial numbers of the herein shown and described embodiments have been made, tested and used, and all have performed in an eminently satisfactory manner.

Figure 1:
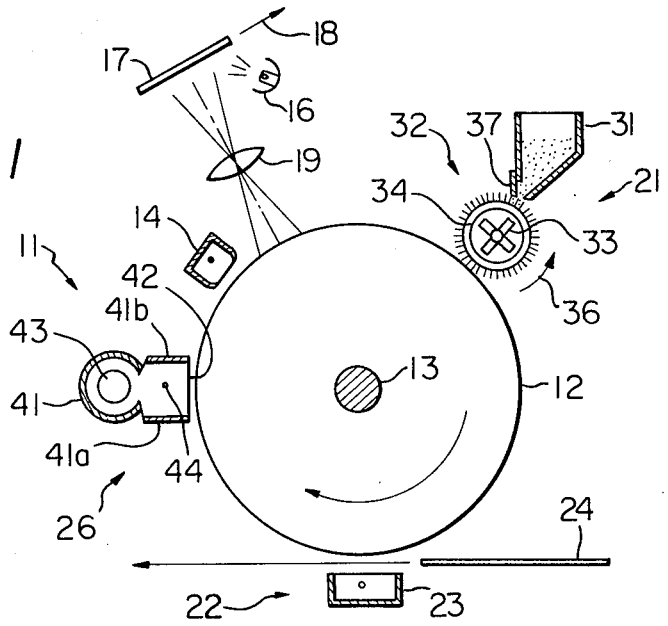
FIG. 1 is a schematic view of an electrophotographic apparatus embodying the present invention.

Referring now to FIG. 1, an electrophotographic apparatus 11 embodying the present invention comprises an electrically grounded rotary drum 12 formed with a photoconductive dielectric surface layer (not designated) and which is supported by a drive shaft 13. Drive means (not shown) rotate the shaft 13 and thereby the drum 12 clockwise at constant speed. A corona charging unit 14 is disposed adjacent to the periphery of the drum 12 and operative to electrostatically charge the surface of the drum 12 in the absence of light. A light source 16 is arranged to illuminate an original document 17 which is moved by a scanning system (not shown) in the direction of an arrow 18 at a speed equal to the tangential speed of the surface of the drum 12 in such a manner that an imaging system, shown in simplified form as a converging lens 19, radiates a light image of the document 17 onto the surface of the drum 12. The highlight areas of the light image cause the photoconductive layer of the drum 12 to conduct thereby dissipating the electrostatic charge in these areas and forming an electrostatic image of the document 17. A developing unit 21 which will be described in detail below applies a powdered toner substance to the drum 12 which is electrostatically attracted to the areas of the photoconductive layer in which the electrostatic charge is high, which correspond to the dark or background areas of the document 17. The developing unit 21 thereby forms a toner image of the document 17 on the drum 12.

At a transfer unit 22 comprising a corona charging unit 23 similar to the corona charging unit 14, a copy sheet 24 is fed in synchronized contact with the drum 12 and an electrostatic force is applied to the back of the sheet 24 thereby attracting and effecting transfer of the toner image to the sheet 24. A fixing unit (not shown) subsequently fixes the toner image by heat, pressure or both to the copy sheet 24. A discharge unit 26 then completely discharges the drum 12 and any residual toner is removed by the developing unit 21 as will be described in detail below.

The developing unit 21 comprises a hopper 31 which is filled with a powdered developing or toner substance preferably in the form of tiny granules or particles. Each granule comprises at least one particle of black carbon and at least one particle of iron, said particles being rigidly held together by a resin binder. A magnetic brush 32 is disposed closely adjacent to the surface of the drum 12 below an opening in the hopper 31 and comprises a magnetic core 33 surrounded by a non-magnetic sleeve 34, the core 33 and sleeve 34 being coextensive with the length of the drum 12. Either one or both of the core 33 and sleeve 34 are rotated so that toner from the hopper 31 is magnetically attracted to the magnetic brush 32 to form an accumulation of toner particles on the surface of the sleeve 34 and rotates in the direction of an arrow 36 which brushingly engages with the surface of the drum 12. A doctor 37 is provided at the opening of the hopper 31 to limit the thickness of the toner substance on the sleeve 34 to a required value. Due to the brushing engagement of the toner on the magnetic brush 32 with the surface of the drum 12, the toner is applied to the drum 12 to effect development of the electrostatic image into the toner image. The magnetic force of the magnetic core 33 is selected so that it is less than the electrostatic attraction between the electrostatic image on the drum 12 so that the toner may be transferred from the magnetic brush 32 to the drum 12 for development.

The discharge unit 26 comprises a housing 41 which acts as a light and electrical shield, the housing 41 being opaque, electrically conductive and electrically grounded. The housing 41 is coextensive with the length of the drum 12 and is formed with an opening 42 facing the drum 12. A light source 43 such as a fluorescent bulb is disposed in the housing 41 such that light from the light source 43 is radiated onto the surface of the drum 12 through the opening 42. A corona discharge electrode 44 is further disposed in the housing 41 such that an electric field of opposite polarity to that of the charging unit 14 is applied to the surface of the drum 12 through the opening 42.

Figure 2:
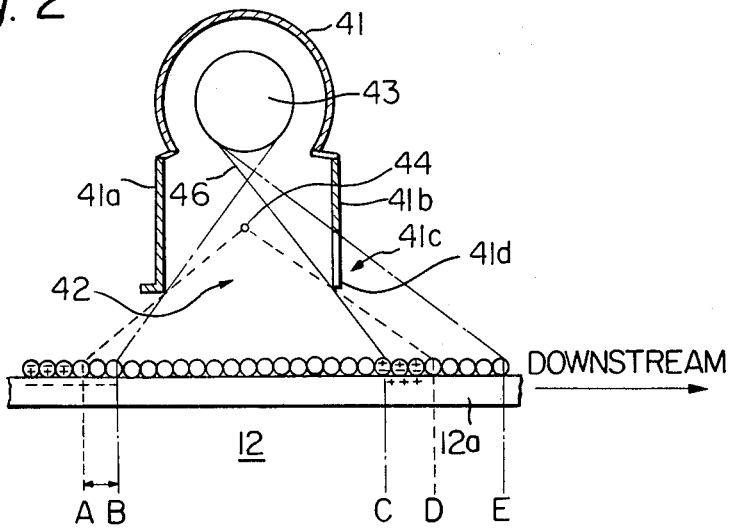
FIG. 2 is an enlarged schematic view illustrating an important aspect of the present invention.

As shown in FIG. 2, the housing 41 comprises, adjacent to the opening 42, an upstream wall 41*a* and a downstream wall 41*b*, the designations upstream and downstream referring to the direction of movement of the surface of the drum 12. The end of the downstream wall 41*b* adjacent to the drum 12 is cut away to define an opening 41*c*, and an electrically conductive transparent plate 41*d* formed of, for example NESA (trademark) glass, is fitted in the opening 41*c*.

In FIG. 2 the photoconductive surface layer of the drum 12 is designated as 12*a* and toner particles attracted to the surface layer 12*a* are shown as circles but are not designated by reference numerals. Due to the electrical shielding effect of the walls 41*a* and 41*b*, the electric field from the corona discharge electrode 44 is applied to the layer 12*a* in an area bounded by lines A and D as indicated by dashed lines leading from the electrode 44 to the layer 12*a*. The light from the light source 43 is radiated onto the layer 12*a* in an area bounded by lines B and E as indicated by dot-dash lines leading from the light source 43 to the layer 12*a*. It will be noted that the light passes through the plate 41*d* whereas the electric field is blocked or shielded thereby.

The light from the light source 43 and the electric field produced by the corona discharge electrode 44 are superimposed on the layer 12*a* in an area bounded by the lines B and D such that the layer 12*a* is simultaneously irradiated by light and electrically discharged in this position. The polarity of the corona discharge electrode 44 is opposite to that of the corona charging unit 14 so that the electrostatic image on the drum 12 is neutralized. The light causes photoconduction in the layer 12*a* so that any remaining charge on the layer 12*a* is shorted to ground due to the high conductivity of the layer 12*a*. In this manner, the charge on both the layer 12*a* and toner particles is completely removed, a result which cannot be achieved by corona discharge followed by exposure to light.

Assuming that the charge applied to the layer 12*a* by the charging unit 14 is negative in polarity, the polarity of the discharge electrode 44 is positive. The negative charge at the surface of the layer 12*a* produces electrostatic polarization of the toner particles so that they are positive at their ends next to the layer 12*a* and negative at their ends away from the layer 12*a*, thereby being electrostatically attracted to the layer 12*a*. A similar magnetic phenomenon attracts the toner particles to the magnetic brush 32 of the developing unit 31.

As viewed in FIG. 2, the electric field of the electrode 44 extends further upstream than the light from the light source 43, such that only the electric field exists in an area bounded by the lines A and B. This is of no practical consequence, and the housing 41 may be designed so that the electric field and light extend the same distance upstream or the light extends further upstream than the electric field. What is important, however, is that the electric field does not extend further downstream than the light.

If the plate 41*d* were opaque, the light from the light source 43 would be confined to an area on the layer 12*a* between the line B and a line C, as indicated by a solid line 46 leading from the light source 43 to the layer 12*a*, and only the electric field would exist in an area bounded by the lines C and D. As a result, the layer 12*a* would be electrostatically charged with a positive polarity, thereby inducing electrostatic polarization in the toner particles opposite to the normal polarity. The toner particles would be caused to be attracted to the layer 12*a* by the action of the discharge electrode 44, thereby defeating the purpose of the discharge unit 26. Since the toner particles would be attracted to the layer 12*a* as a result of the operation of the discharge electrode 44, it would be impossible for the magnetic brush 32 to completely remove the residual toner particles from the drum 12. However, due to the provision of the plate 41*d*, the light extends further downstream than the electric field and the problem of reverse charging of the layer 12*a* and toner particles is eliminated.

After operation on the drum 12 by the discharge unit 26, the magnetic brush 32 removes the residual toner particles from the drum 12 through physical contact. Since the electrostatic attractive force between the drum 12 and toner particles is reduced to substantially zero by the discharge unit 26, the magnetic attractive force of the magnetic brush 32 is effective in effecting complete transfer of the residual toner particles to the magnetic brush 32.

For each copying operation, the drum 12 is rotated through two revolutions. During the first revolution the copying operation is performed and the discharge unit 26 operates on the drum 12. During the second revolution, the charging unit 14 and light source 16 are deenergized so that the drum 12 is operated on by the magnetic brush 32 for removal of the residual toner after operation thereon by the discharge unit 26. Of course, if a second magnetic brush (not shown) is provided between the discharge unit 26 and charging unit 14, the entire copying and drum cleaning operation may be performed during one revolution of the drum 12, with the magnetic brush 32 serving only the developing function.

Figure 3:
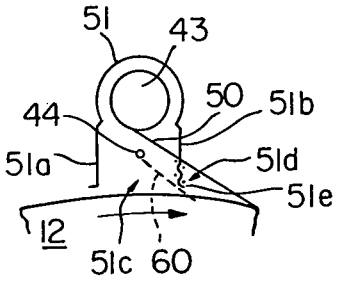
FIGS. 3 to 5 are fragmentary schematic views illustrating respective modifications of the present electrophotographic apparatus.
Figure 4:
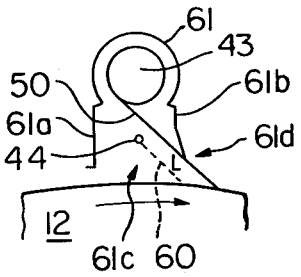
Figure 5:
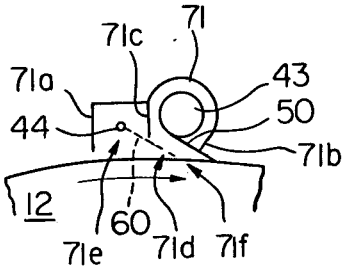

FIGS. 3 to 5 illustrate alternative forms of the housing 41 which provide the same function. In these Figures, a solid line 50 indicates the downstream limit of radiation of the light from the light source 43 and a dashed line 60 indicates the downstream limit of the electric field from the discharge electrode 44. Since the light source 43 and discharge electrode 44 are identical in all forms, the same reference numerals are utilized.

In FIG. 3 a housing 51 comprises an upstream wall 51*a* and a downstream wall 51*b* which have formed therebetween an opening 51*c* facing the drum 12. The downstream wall 51*b* is formed with an opening 51*d* in which is fitted an electrically conductive screen 51*e*. The screen 51*e* is substantially transparent to light but acts as a shield to the electric field, and serves the same function as the plate 41*d*.

In FIG. 4 a housing 61 comprises an upstream wall 61*a* and a downstream wall 61*b* which have formed therebetween an opening 61*c* facing the drum 12. The downstream wall 61*b* is perforated and bent outwardly to define an opening 61*d* which allows light to extend further downstream from the housing 61 than the electric field as indicated.

FIG. 5 shows a housing 71 which differs in construction from the housing 41 and comprises an upstream wall 71*a* and a downstream wall 71*b*. Whereas in the housing 41 the discharge electrode 44 is disposed between the light source 43 and the drum 12, in the housing 71 the light source 43 is arranged downstream of the discharge electrode 44. A partition wall 71*c* is provided in the housing 71 between the light source 43 and discharge electrode 44 and cut away at its bottom end to define an opening 71*d*. The walls 71*a* and 71*c* have formed therebetween an opening 71*e* facing the drum 12 and the walls 71*b* and 71*c* have formed therebetween an opening 71*f* facing the drum 12. The opening 71*d* is formed in such a manner that the electric field extends into the opening 71*f* but the light extends further downstream than the electric field.

Many modifications of the preferred embodiments shown and described within the scope of the invention will become possible for those skilled in the art after receiving the teaching of the present disclosure. For example, the invention is practically operable if the discharge electrode 44 is adapted to apply an alternating electric field to the drum 12 rather an electric field of opposite polarity to that of the charging unit 14.

What is claimed is:

1. In an electrophotographic process in which a photoconductive member is electrostatically charged, radiated with a light image to produce an electrostatic image, developed by application of a toner substance thereto to form a toner image and subjected to a transfer operation in which the toner image is transferred to a copy sheet, an improvement for removing residual toner substance from the photoconductive member after the transfer operation comprising the steps of:

(a) radiating light uniformly onto the photoconductive member to cause photoconduction;

(b) applying an electric field to the photoconductive member to substantially neutralize the electrostatic charge simultaneously with performing step (a);

(c) superimposing the electric field on the light in an area on the photoconductive member; and (d) subsequently removing the residual toner substance from the photoconductive member.

2. A process as in claim 1, in which the toner substance comprises at least one particle of black carbon and at least one particle of iron, step (d) being performed by applying a magnetic brush of said toner substance to the photoconductive member.

3. A process as in claim 2, in which the photoconductive member is developed by applying said magnetic brush thereto.

4. A process as in claim 1, in which the photoconductive member moves through a position at which steps (a) and (b) are performed, the light extending further downstream from said position than the electric field in a direction of movement of the photoconductive member.

5. In an electrophotographic apparatus including a photoconductive member, a charging unit for applying an electrostatic charge to the photoconductive member, an imaging unit for radiating a light image onto the photoconductive member to produce an electrostatic image, a developing unit for applying a toner substance to the photoconductive member to form a toner image and a transfer unit for transferring the toner image to a copy sheet, an improvement for removing residual toner substance from the photoconductive member after operation thereon by the transfer unit comprising:

a light source for radiating light uniformly onto the photoconductive member to cause photoconduction;

an electrical discharge unit disposed between the light source and the photoconductive member for applying an electric field to the photoconductive member to substantially neutralize the electrostatic charge thereon simultaneously with the radiation of the light, the electric field being superimposed on the light in an area on the photoconductive member, and a cleaning unit for subsequently removing the residual toner substance from the photoconductive member through contact therewith.

6. An apparatus as in claim 5, in which the toner substance comprises at least one particle of iron, the cleaning unit comprising a magnetic brush of said toner substance.

7. An apparatus as in claim 6, in which the developing unit comprises said magnetic brush.

8. An apparatus as in claim 5, in which the photoconductive member comprises a rotary drum formed with a photoconductive surface, the charging unit, imaging unit, developing unit, transfer unit, light source, discharge unit and cleaning unit being circumferentially arranged adjacent to the surface of drum.

9. An apparatus as in claim 5, in which the photoconductive member moves through a position at which the light source and discharge unit act thereon, the light source being constructed and arranged such that the light therefrom extends further downstream from said position than the electric field from the discharge unit in a direction of movement of the photoconductive member.

10. An apparatus as in claim 9, further comprising a housing enclosing the light source and discharge unit and constituting a light and electrical shield, the housing being formed with an opening facing the photoconductive member and means for causing the light from the light source to extend further downstream from said position than the electric field from the discharge unit in the direction of movement of the photoconductive member.

11. An apparatus as in claim 10, in which said means comprises a downstream wall of the housing formed with a secondary opening oriented such that light from the light source propagates therethrough onto the photoconductive member.

12. An apparatus as in claim 11, in which said means further comprises a secondary electrical shield mounted in the secondary opening, the secondary electrical shield being substantially transparent to the light.

13. An apparatus as in claim 12, in which the secondary electrical shield comprises an electrically conductive screen.

14. An apparatus as in claim 12, in which the secondary electrical shield comprises an electrically conductive plate.

15. An apparatus as in claim 10, in which the light source is disposed downstream of the discharge unit in the housing, said means comprising a secondary electrical shield disposed between the light source and discharge unit.

16. An apparatus as in claim 15, in which at least part of the secondary electrical shield is transparent to the light.

17. An apparatus as in claim 15, in which the secondary electrical shield is formed with an opening.

18. An apparatus as in claim 5, in which the discharge unit comprises a corona discharge unit.

19. An apparatus as in claim 5, in which the developing unit and cleaning unit are integral and comprise a single magnetic brush for applying the toner substance to the photoconductive member to form the toner image and removing the residual toner substance from the photoconductive member.

20. Apparatus for removing residual toner substance from a photoconductive member, the apparatus being utilized with an electrophotographic machine of the type including a photoconductive member, a charging unit for applying an electrostatic charge to the photoconductive member, an imaging unit for radiating a light image onto the photoconductive member to produce an electrostatic image, a developing unit for applying a toner substance to the photoconductive member to form a toner image and a transfer unit for gransferring the toner image to a copy sheet, an improvement comprising:

(a) means for removing residual toner substance from the photoconductive member after operation thereon by the transfer unit, said means comprising a light source for radiating a light uniformly onto the photoconductive member to cause photoconduction and an electrical discharge unit disposed between the light source and the photoconductive member for simultaneously applying in superimposed relationship an electric field to the photoconductive member to substantially neutralize the electrostatic charge thereon; and (b) a cleaning unit for subsequently removing the residual toner substance from the photoconductive member through contact therewith.

21. A process for removing residual toner substance from a photoconductive member, the process being utilized in electrophotography of the type in which a photoconductive member is electrostatically charged, radiated with a light image to produce an electrostatic image, developed by application of a toner substance thereto to form a toner image and subjected to a transfer operation in which the toner image is transferred to a copy sheet, the improvement comprising:

(a) removing residual toner substance from the photoconductive member after the transfer operation by radiating light uniformly onto the photoconductive member to cause photoconduction and simultaneously with said radiating of a light superimposing the application of an electric field to the photoconductive member to substantially neutralize the electrostatic charge; and (b) subsequentially removing the residual toner substance from the photoconductive member.

* * * * *